US010888489B2

(12) United States Patent
Katsiris

(10) Patent No.: US 10,888,489 B2
(45) Date of Patent: Jan. 12, 2021

(54) WALKING AID AND WHEEL ASSEMBLY THEREFOR

(71) Applicant: MYBRAINWAVE PTY LTD, Rockdale (AU)

(72) Inventor: John Katsiris, Rockdale (AU)

( * ) Notice: Subject to any disclaimer, the term of this patent is extended or adjusted under 35 U.S.C. 154(b) by 0 days.

(21) Appl. No.: 15/780,794

(22) PCT Filed: Dec. 2, 2016

(86) PCT No.: PCT/AU2016/051193

§ 371 (c)(1),
(2) Date: Jun. 1, 2018

(87) PCT Pub. No.: WO2017/091867

PCT Pub. Date: Jun. 8, 2017

(65) Prior Publication Data

US 2019/0254916 A1 Aug. 22, 2019

(30) Foreign Application Priority Data

Dec. 3, 2015 (AU) ..... 2015905026

(51) Int. Cl.
*A61H 3/04* (2006.01)
*A45B 1/02* (2006.01)
*A61H 3/02* (2006.01)

(52) U.S. Cl.
CPC ..... *A61H 3/04* (2013.01); *A45B 1/02* (2013.01); *A61H 3/02* (2013.01); *A61H 2003/046* (2013.01); *A61H 2201/0192* (2013.01)

(58) Field of Classification Search
CPC ... A61H 3/00; A61H 3/02; A61H 3/04; A61H 2003/046; A61H 2003/0216
See application file for complete search history.

(56) References Cited

U.S. PATENT DOCUMENTS 4,962,781 A * 10/1990 Kanbar ..... A45B 1/02 135/65
5,188,138 A * 2/1993 Yamasaki ..... A61H 3/04 135/65

(Continued)

FOREIGN PATENT DOCUMENTS

AU 1992027279 A 8/1993
AU 1994061852 A 11/1994

(Continued)

OTHER PUBLICATIONS

International Search Report dated Jan. 27, 2017, issued in PCT Patent Application No. PCT/AU16/051193.

(Continued)

*Primary Examiner* — Bryan A Evans
(74) *Attorney, Agent, or Firm* — Thomas M. Joseph, Esq

(57) ABSTRACT

In one aspect there is disclosed a walking aid (10). The walking aid (10) comprises a support leg (12) having an operative upper end (16) and an operative lower end (18). The walking aid (10) further comprises a wheel assembly (14) for operative attachment to the lower end (18) of the support leg (12). The wheel assembly (1.4) is adapted to be pushed in a forward direction by a user resting on the support leg (12). The wheel assembly (14) comprises a chassis (26) supporting (i) at least one wheel (28) and (ii) a stop (30). The stop (30) is operatively adapted to co-operate with the at least one wheel (30) such that a torque applied to the support leg (12) by the user will arrest movement of the wheel assembly (14) in the forward direction.

15 Claims, 4 Drawing Sheets

(56) References Cited

U.S. PATENT DOCUMENTS

| | | | | |
|---|---|---|---|---|
| 5,692,533 | A | 12/1997 | Meltzer | |
| 6,158,453 | A * | 12/2000 | Nasco | A45B 1/02 135/77 |
| 6,708,705 | B2 * | 3/2004 | Nasco, Sr. | A45B 9/00 135/66 |
| 7,252,105 | B2 * | 8/2007 | Otis | A45B 1/02 135/78 |
| 8,020,881 | B2 * | 9/2011 | Stump | A61H 3/04 280/200 |
| 9,016,297 | B2 * | 4/2015 | Salomon | A45B 1/02 135/66 |
| 9,592,175 | B2 * | 3/2017 | Soulakis | A61H 3/02 |
| 10,327,976 | B1 * | 6/2019 | Boushehri | A61H 3/04 |
| 2003/0205265 | A1 * | 11/2003 | Nasco, Sr. | A45B 9/00 135/65 |
| 2004/0216776 | A1 * | 11/2004 | Otis | A45B 1/02 135/85 |
| 2006/0162754 | A1 * | 7/2006 | Karasin | A61H 3/00 135/85 |
| 2007/0249472 | A1 | 10/2007 | Frei | |
| 2008/0017228 | A1 * | 1/2008 | Karasin | A61H 3/00 135/85 |
| 2010/0117326 | A1 * | 5/2010 | Stump | A61H 3/04 280/200 |
| 2014/0196757 | A1 * | 7/2014 | Goffer | A61H 3/02 135/66 |
| 2014/0261592 | A1 * | 9/2014 | Westerlund | A61H 3/02 135/68 |
| 2014/0261594 | A1 * | 9/2014 | Salomon | A45B 1/02 135/85 |
| 2016/0058648 | A1 * | 3/2016 | Soulakis | A61H 3/02 135/68 |
| 2019/0224065 | A1 * | 7/2019 | Hashimoto | A61H 3/04 |

FOREIGN PATENT DOCUMENTS

| | | | |
|---|---|---|---|
| AU | 199645833 | B2 | 9/1996 |
| AU | 200019518 | A1 | 8/2001 |
| AU | 2004201638 | A1 | 11/2004 |
| AU | 2009201503 | A1 | 11/2010 |
| AU | 2011331137 | B2 | 5/2012 |
| CA | 2180629 | C | 1/1997 |
| CN | 103892530 | A | 7/2014 |
| EP | 1744817 | B1 | 11/2007 |
| GB | 2303061 | A | 12/1997 |
| GB | 2303061 | B | 6/1999 |
| JP | H09154902 | A | 6/1997 |
| JP | 2007536027 | A | 12/2007 |
| JP | 4611379 | B2 | 1/2011 |
| WO | 2005102096 | A2 | 11/2005 |
| WO | 2005105220 | A1 | 11/2005 |
| WO | 2009097520 | A1 | 6/2009 |

OTHER PUBLICATIONS

Written Opinion dated Jan. 27, 2017 issued in PCT Patent Application No. PCT/AU16/051193.
Machine Translation for CN103892530 Abstract.
Machine Translation for CN103892530 Specification.
Machine Translation for CN103892530 Claims.
FLICKR Search Results, Fredrik Forsberg, Cane on Wheels, downloaded on Wednesday, Oct. 22, 2014.
Google Search Results, downloaded on Wednesday, Oct. 22, 2014.
Alibaba Search Results, downloaded on Wednesday, Oct. 22, 2014.

* cited by examiner

WALKING AID AND WHEEL ASSEMBLY THEREFOR

CROSS REFERENCE TO RELATED APPLICATIONS

The present application is a U.S. national stage application of PCT International Application No. PCT/AU2016/051193, filed Dec. 2, 2016, and published as PCT Publication WO/2017/091867 on Jun. 8, 2017, which claims priority to Australian Application No. AU2015905026, filed on Dec. 3, 2015. The disclosures of all the foregoing applications are hereby incorporated by reference in their entirety into the present application.

FIELD

The invention concerns a walking aid and a wheel assembly therefor. In particular, but not exclusively, the invention concerns a walking aid for assisting walking of (i) an active elderly person or (ii) a user recovering from surgery.

BACKGROUND

The oldest form of a walking aid is the so-called walking stick or cane. A walking stick typically comprises a single support leg with a transverse handle to be held by a user. Though easy to use and relatively inexpensive to produce, walking sticks suffer from the drawback that they must be raised by a user with each advancing step. Although a walking stick typically is not heavy, an elderly user or a user recovering from surgery may be weak and as a result tire relatively quickly when using a walking stick. Walking sticks also suffer from the drawback of being unattractive and may cause a user to feel awkward.

Another type of walking aid is a walking frame. A conventional walking frame comprises a three-sided framework produced from light-weight metal. The walking frame includes a rail that is grasped by a user and legs for resting on a ground surface. As with a walking stick, a walking frame must also be raised by the user for each advancing step and thus suffers the same drawbacks associated with walking sticks. Another problem with walking frames is that they tend to be relatively bulky, making them difficult to manoeuvre in confined spaces.

Yet another type of walking aid is a crutch. A crutch typically comprises a long leg with a cross-piece upper used as a support under the armpit of a user. For many users a crutch may prove difficult to use and to maintain their balance. Use of a crutch also makes it hard, for example to carry articles such as, for example, shopping bags.

With a view of addressing the drawbacks associated with the above described walking aids, rolling canes have become commercially available. Rolling canes are typically collapsible and include a front leg with a bottom end on which a double wheel is mounted. An upper end of the leg has a handle attached thereto. A rear leg, having a double-wheel mounted to its bottom end, is pivotally connected to the front leg. The front and rear legs are bridged by a folding arm, such that when the arm is extended, the legs are angled and the front and rear double wheels operatively engage the ground at spaced apart points. When the arm is folded, the legs are parallel to each other, thereby collapsing the rolling cane.

A great advantage of a rolling cane is that a user is not required to lift the cane with each forward step. Rolling canes, however, suffer from a number of disadvantages. One disadvantage results from the fact that the front leg is hinged to the rear leg to enable steering of the rolling cane. That feature can cause the rolling cane to become unstable as there is nothing to prevent the cane from swaying from side to side.

OBJECT

It is the object of the present invention to provide a useful alternative to existing walking aids.

SUMMARY

According to a first aspect of the present invention there is disclosed herein a walking aid comprising:

(i) a support leg having an operative upper end and an operative lower end; and (ii) a wheel assembly for operative attachment to the lower end of the support leg whereby the wheel assembly is adapted to be pushed in a forward direction by a user resting on the support leg, the wheel assembly comprising a chassis supporting (a) at least one wheel and (b) a stop, wherein the stop is operatively adapted to co-operate with the at least one wheel such that a torque applied to the support leg by the user will arrest movement of the wheel assembly in the forward direction.

According to a second aspect of the invention there is disclosed herein a wheel assembly for operative attachment to an operative lower end of a support leg of a walking aid, the wheel assembly being adapted to be pushed in a forward direction by a user resting on the support leg, the wheel assembly comprising a chassis supporting (a) at least one wheel and (b) a stop, wherein the stop is operatively adapted to co-operate with the at least one wheel such that a torque applied to the support leg by the user will arrest movement of the wheel assembly in the forward direction.

Preferably the support leg has a handle attached to the operative upper end.

Preferably the wheel assembly includes an attachment formation to facilitate detachable attachment of the support leg to the wheel assembly.

Preferably the attachment formation includes a foot having a recess shaped to receive and hold the operative lower end of the support leg.

Preferably the attachment formation includes a connector having a leg connecting formation for receiving and holding an operative lower portion of the support leg.

Preferably the leg connecting formation comprises a loop which encircles an operative lower portion of the support leg.

Preferably the wheel assembly comprises two wheels.

Preferably the wheel assembly comprises three wheels.

Preferably the wheels are oriented in-line on the chassis with axles of the wheels being parallel spaced apart along the chassis.

Preferably the stop comprises an oblong stop body.

Preferably the stop body is produced from a polymer or an elastomer.

Preferably the stop body is orientated in-line on the chassis with the wheels of the wheel assembly.

Preferably the support leg is of telescopic construction so as to facilitate height adjustment to suit the height of a user.

BRIEF DESCRIPTION OF THE DRAWINGS

Preferred embodiments of the invention will be described hereinafter, by way of examples only, with reference to the accompanying drawings.

In the drawings.

DESCRIPTION OF PREFERRED EMBODIMENTS

Figure 1:
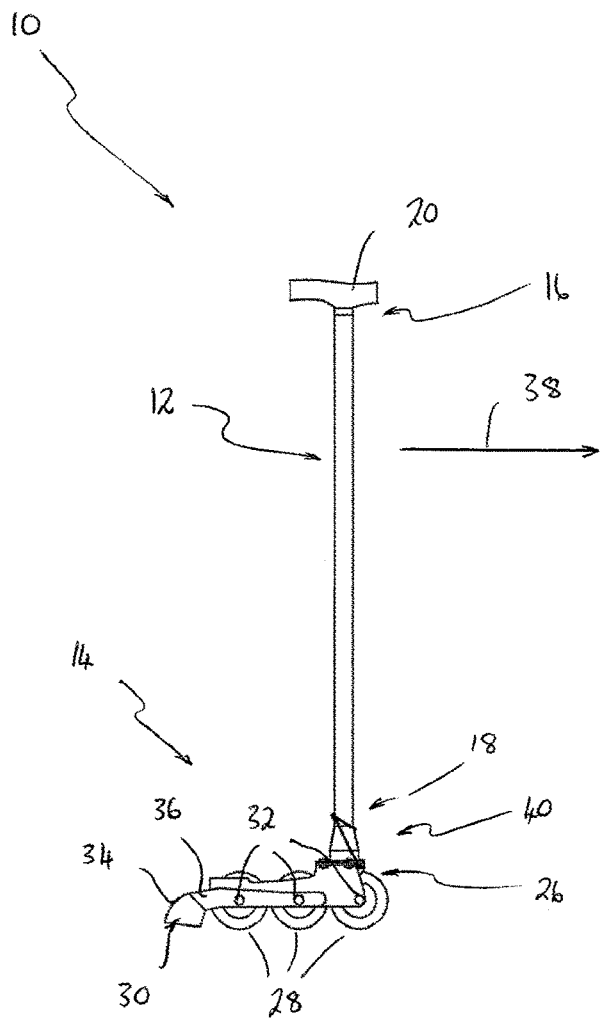
FIG. 1 is a schematic side view of a first embodiment walking aid.

In the description which follows below like reference numerals are used to indicate like components.

FIGS. 1 to 4 show a first embodiment walking aid, generally indicated with the reference numeral 10. The walking aid 10 comprises a support leg 12 and a wheel assembly 14 for operative attachment to the support leg 12. In use the wheel assembly 14 is adapted to be pushed in a forward direction by a user resting on the support leg 12.

Figure 2:
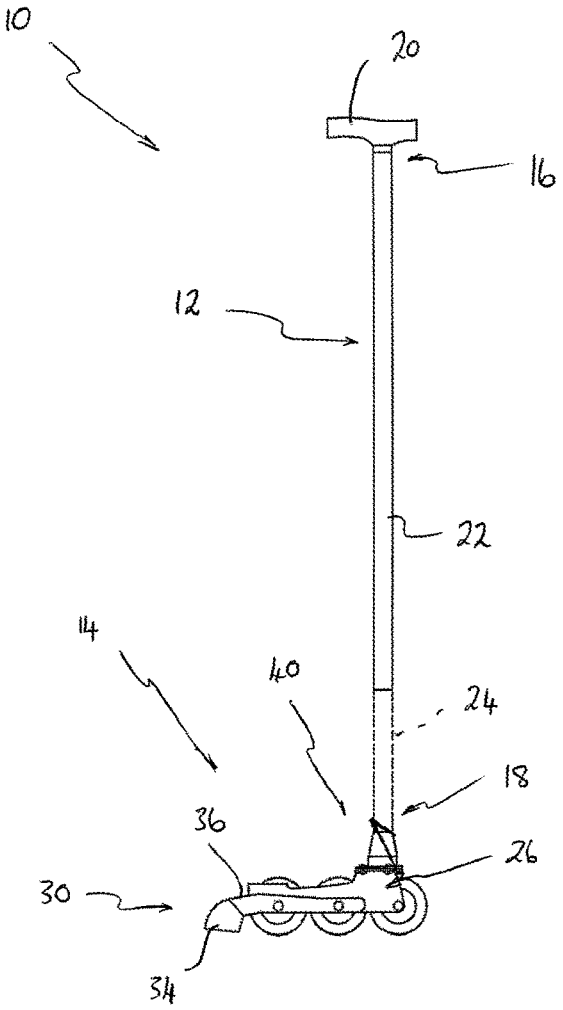
FIG. 2 is a schematic side view of the walking aid of FIG. 1 with a support leg of the walking aid located in an extended position.
Figure 3:
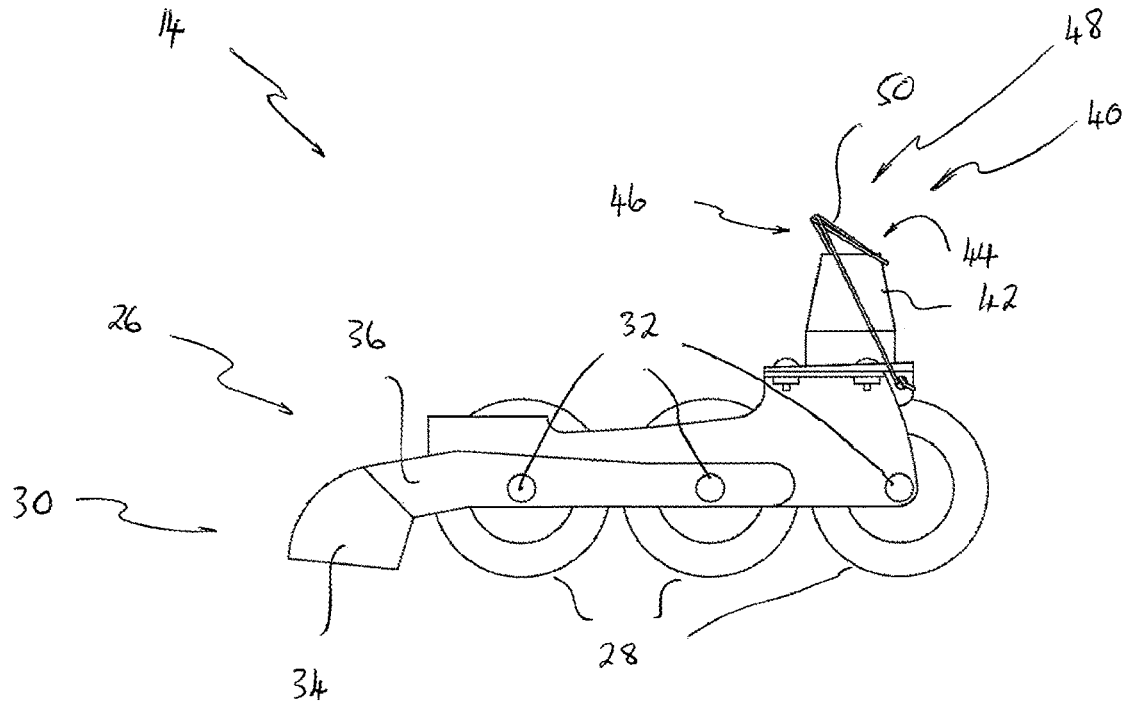
FIG. 3 is a schematic side view of a wheel assembly of the walking aid of FIG. 1.
Figure 4:
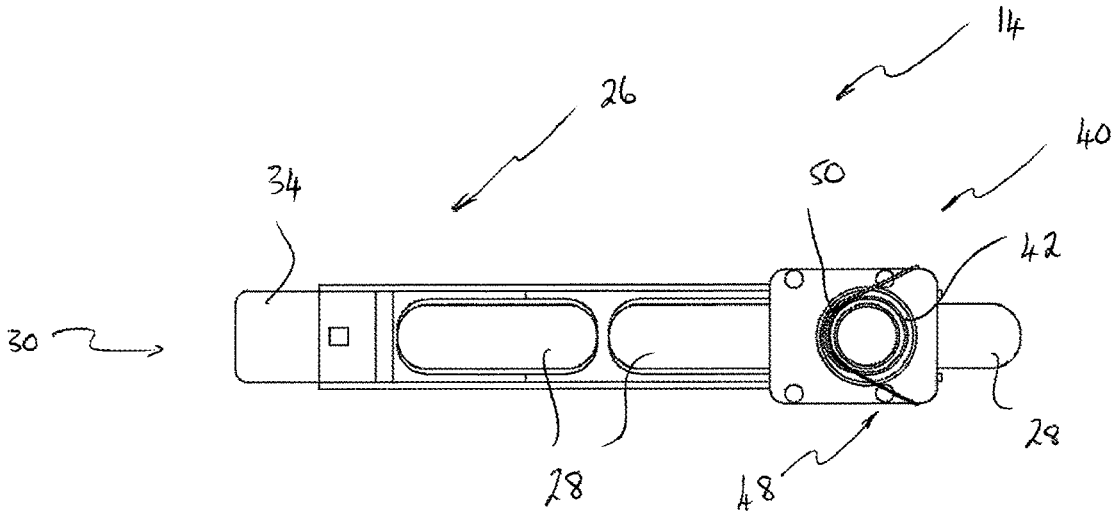
FIG. 4 is a schematic top view of the wheel assembly of FIG. 3.
Figure 5:
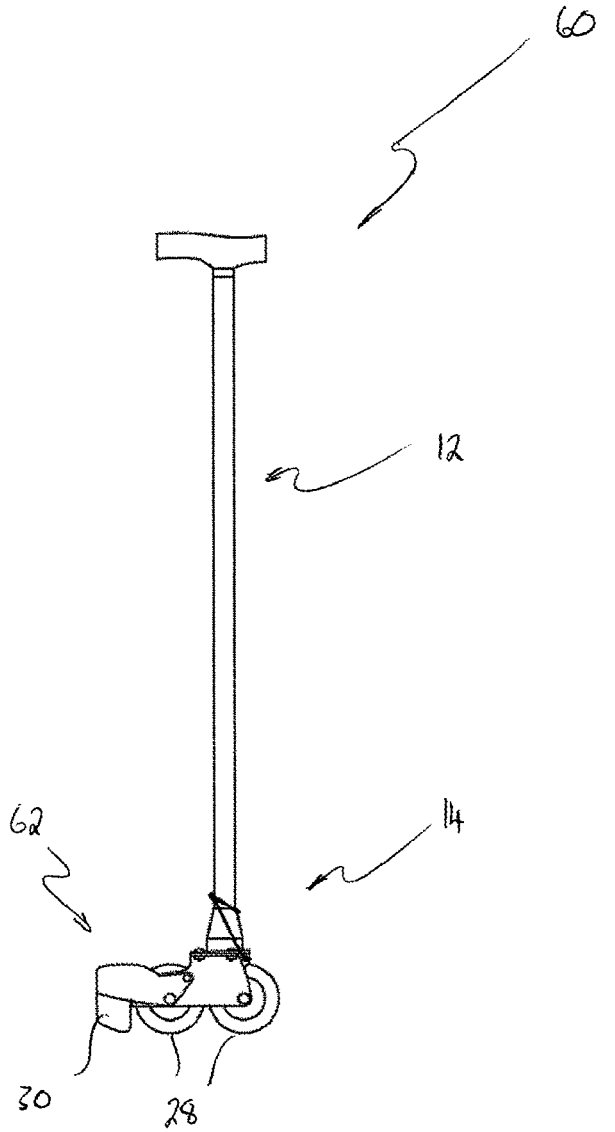
FIG. 5 is a schematic side view of a second embodiment walking aid.
Figure 6:
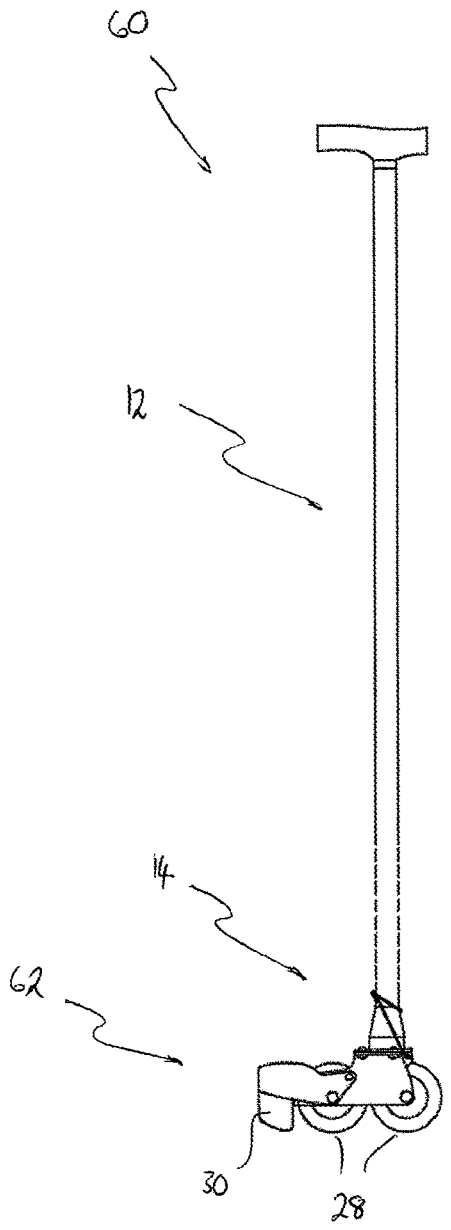
FIG. 6 is a schematic side view of the walking aid of FIG. 5 with a support leg of the walking aid located in an extended position.
Figure 7:
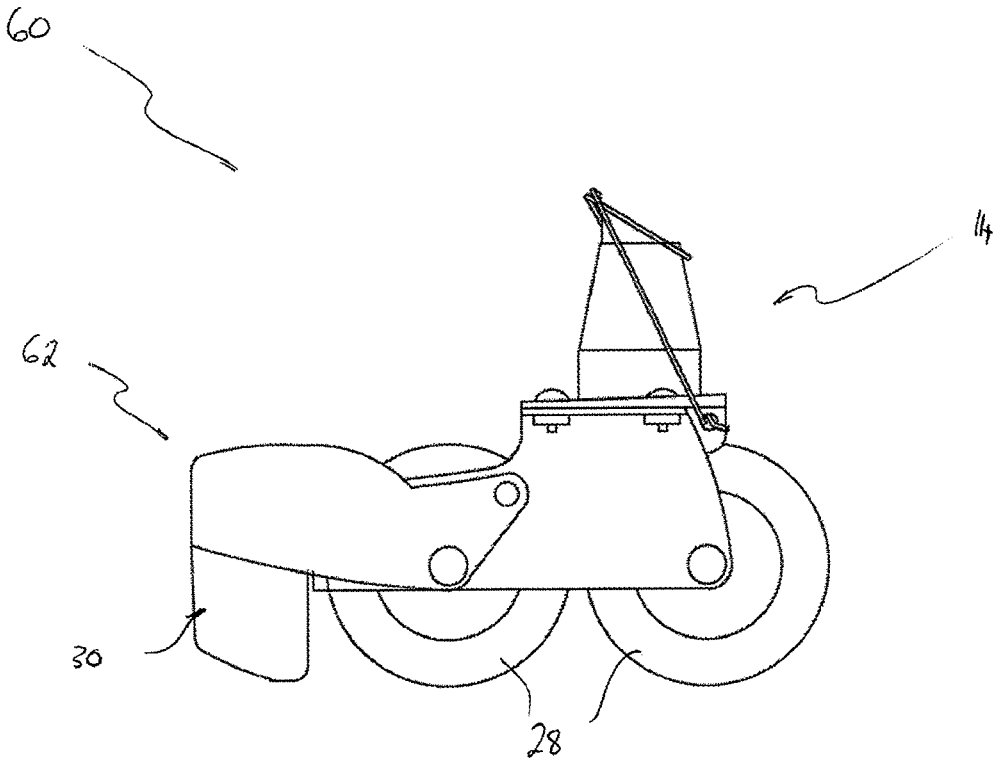
FIG. 7 is a schematic side view of a wheel assembly of the walking aid of FIG. 5.
Figure 8:
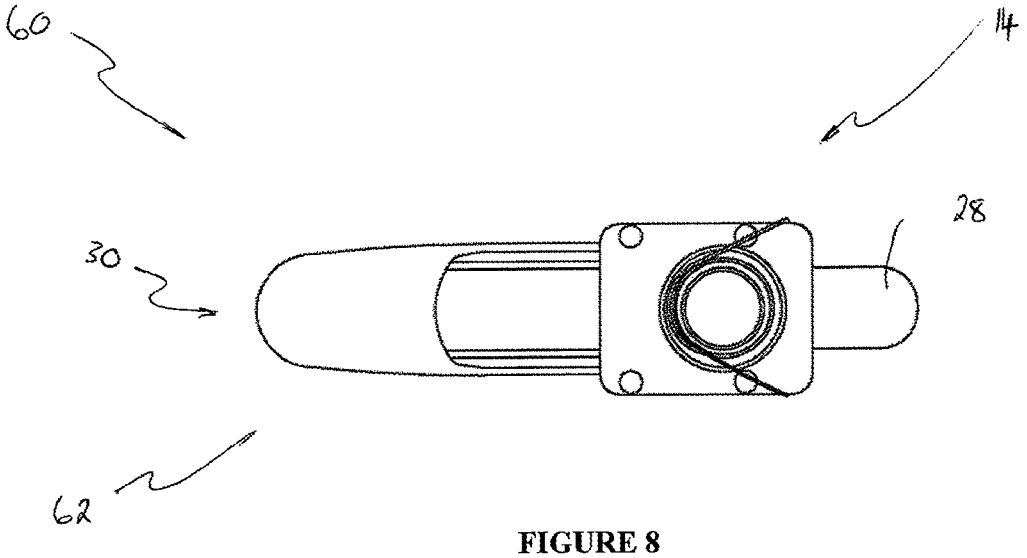
FIG. 8 is a schematic top view of the wheel assembly of FIG. 7.

The support leg 12 is of elongate configuration and includes an operative upper end 16 and an operative lower end 18. In this embodiment the support leg 12 comprises an elongate rod (stick) which longitudinally extends between the operative upper end 16 and the operative lower end 18. A handle 20 is attached to the operative upper end 16 of the support leg 12. As shown in FIG. 2, the support leg 12 is of telescopic construction so as to facilitate height adjustment to suit the height of a user. To this end the support leg 12 comprises a first leg member 22 which slidably receives a second leg member 24. Although not illustrated, the support leg 12 will typically include a spring-biased detent which is receivable within a hole selected from a series of holes in a longitudinal row spaced along the support leg 12. A user can accordingly readily adjust and set the extent to which the second support member 24 is telescoped within the first support member 22, thereby to adjust the elevation of the handle 20 to a desired height.

As shown, the wheel assembly 14 is adapted for operative attachment to the lower end 18 of the support leg 12. The wheel assembly 14 comprises a chassis 26 which supports three wheels 28 and a stop 30. The wheels 28 are oriented in-line on the chassis 26 with axles 32 of the wheels 28 being parallel spaced apart along the chassis 26.

The stop 30 includes an oblong stop body 34 produced from an elastomer, here rubber. It will of course be appreciated that the stop body 34 could be produced from a range of materials such as different types of polymers. The stop body 34 is secured to a stop arm 36 which in turn is secured to the chassis 26.

The stop 30 is operatively adapted to co-operate with the wheels 28 such that a torque applied to the support leg 12 by the user will arrest movement of the wheel assembly in a forward direction, indicated by the arrow 38 in FIG. 1. Such torque could be the result of the support leg 12 moving in a rearward direction prompting the wheel assembly 14 to slip in the forward direction 38 and tipping upwards. The stop 30 further serves to promote correct orientation of the walking aid 10 to deter poor orientation as the stop 30 will engage the ground as the support leg 12 is tilted backwards (i.e., in a direction opposite to that indicated by arrow 38).

The wheel assembly 14 includes an attachment formation 40 to facilitate detachable attachment of the support leg 12 to the wheel assembly 14. In this embodiment the attachment formation 40 includes a foot 42 having a recess 44 shaped to receive and hold the operative lower end 16 of the support leg 12. The attachment formation 40 further includes a wire connector 46 having a leg connecting formation 48 for receiving and holding an operative lower portion of the support leg 12. In this embodiment the leg connecting formation 48 comprises a loop 50 which encircles an operative lower portion of the support leg 12. The connector 46 effectively provides a spring to bias the support leg 12 to an operative upright configuration so as to ensure stability when pressed upon by a user.

Typically the foot 42 will be permanently attached to the chassis 26. A user desiring to use the support leg 12 without the wheel assembly 14 can simply remove the support leg 12 and attach a conventional rubber walking stick foot to the operative lower end 18 and use the support leg 12 as a conventional walking stick. In effect the walking aid 10 enables a conventional walking stick to be converted into a wheeled mobility aid.

FIGS. 5 to 8 show a second embodiment walking aid, generally indicated with the reference numeral 60. The walking aid 60 is similar to the walking aid 10 in that it includes a support leg 12 attached to a wheel assembly 14. However, unlike the walking aid 10, the walking aid 60 includes a shortened chassis 62 which supports only two wheels 28, rather than the three wheels of the first embodiment. The wheels 28 of the walking aid 60 are also configured in-line with one another and with the stop 30.

The chassis 26 of the walking aid 10 has a length of about 30 cm whereas the chassis 26 of the walking aid 60 has a length of about 20 cm. The longer wheel base of the walking aid 60 provides additional stability for the less experienced and slightly less agile user.

The walking aid 60 is sufficiently compact so as to fit inside a pocket of athletic shorts. The walking aid 60 can be quickly transitioned into a walking stick when traveling through a park, traversing more rugged terrain, but allowing the user to utilise the walking aid 60 when wishing to go for long walks on regular paved street or park paths whilst still using the walking stick for uneven or rocky locations when needing the greater support a walking stick provides. The walking aids 10 and 60 can still be used to traverse short length grassy areas without the need to change to a walking stick, but they are most effective when using its gliding motion.

The walking aids 10 and 60 provide a transformative mobility aid that allows a user to utilise a regular commercially available walking stick or cane, transforming it as required into an in-line wheeled mobility aid that provides support to affected lower limbs by reducing the downward force on joints by channelling the leaning force horizontally. It allows the user to glide forward when walking with an affected limb rather than limping and applying a downward force on the affected joint or muscle area. The walking aids assist to maintain a normal gate when walking compared to a regular walking stick where this tends not to be the case.

The walking aids 10 and 60 serve to assist a user suffering from (i) an injury, typically Osteoarthritis in the hip or knee, or (ii) recovering from surgery related to these types of afflictions to "walk faster" and with less force placed in the area triggering pain.

Although the invention has been described with reference to specific examples, it will be appreciated by those skilled in the art that the invention may be embodied in many other forms.

The invention claimed is:

1. A walking aid comprising:

(a) a support leg having an operative upper end and an operative lower end; and (b) a wheel assembly for operative detachable attachment to the lower end of the support leg whereby the wheel assembly is adapted to be pushed in a forward direction by a user resting on the support leg, the wheel assembly comprising a chassis supporting (i) a plurality of wheels, and (ii) a stop operatively associated with the plurality of wheels, the stop operatively adapted to engage a ground surface when a torque is applied to the support leg by a user such that ft by applying torque to the support leg the user will arrest movement of the walking aid in the forward direction, and wherein the chassis includes two opposing, laterally spaced apart chassis members, the plurality of wheels oriented in-line between the chassis members with axles of the plurality of wheels being parallel spaced apart along the chassis.

2. A walking aid according to claim 1, wherein the support leg has a handle attached to the operative upper end.

3. A walking aid according to claim 1, wherein the support leg is of telescopic construction so as to facilitate height adjustment to suit the height of a user.

4. A walking aid according to claim 2, wherein the support leg is of telescopic construction so as to facilitate height adjustment to suit the height of a user.

5. A walking aid according to claim 1, further comprising an attachment formation to facilitate detachable attachment of the support leg to the wheel assembly.

6. A walking aid according claim 5, wherein the attachment formation includes a foot having a recess shaped to receive and hold the operative lower end of the support leg.

7. A walking aid according to claim 5, wherein the attachment formation includes a connector having a leg connecting formation for receiving and holding an operative lower portion of the support leg.

8. A walking aid according to claim 6, wherein the attachment formation includes a connector having a leg connecting formation for receiving and holding an operative lower portion of the support leg.

9. A walking aid according to claim 7, wherein the leg connecting formation comprises a loop which encircles an operative lower portion of the support leg.

10. A walking aid according to claim 1, wherein the wheel assembly comprises three wheels.

11. A walking aid according to claim 10, wherein the wheels are oriented in-line on the chassis with axles of the wheels being parallel spaced apart along the chassis.

12. A walking aid according to claim 1, wherein the stop comprises a stop body.

13. A walking aid according to claim 12, wherein the stop body is produced from a polymer or an elastomer.

14. A walking aid according to claim 12, wherein the stop body is orientated in-line on the chassis with the wheels of the wheel assembly.

15. A walking aid according to claim 13, wherein the stop body is orientated in-line on the chassis with the wheels of the wheel assembly.

* * * * *